United States Patent [19]

Strandli

[11] 3,980,021

[45] Sept. 14, 1976

[54] PROJECTILE HAVING AT LEAST TWO CHARGES

[75] Inventor: Kåre Roald Strandli, Raufoss, Norway

[73] Assignee: A/S Raufoss Ammunisjonsfabrikker, Raufoss, Norway

[22] Filed: May 17, 1974

[21] Appl. No.: 471,154

[30] Foreign Application Priority Data

May 18, 1973 Norway ..... 2069/73

[52] U.S. Cl. ..... 102/66; 102/79; 102/56 R; 102/73 R

[51] Int. Cl.[2] ..... F42B 13/12; F42B 13/14

[58] Field of Search ..... 102/66, 73, 79, 56

[56] References Cited

UNITED STATES PATENTS

| | | | |
|---|---|---|---|
| 3,359,901 | 12/1967 | Bedall | 102/73 |
| 3,370,536 | 2/1968 | Francis et al. | 102/66 |
| 3,677,181 | 7/1972 | Giljarhus et al. | 102/66 |

*Primary Examiner*—Verlin R. Pendegrass
*Attorney, Agent, or Firm*—Larson, Taylor and Hinds

[57] ABSTRACT

A projectile having a forwardmost incendiary charge at the forward end of the projectile and arranged to be ignited upon impact of the projectile and one or more other charges located rearwardly thereof. A safety device located between said forwardmost incendiary charge and said other charge or charges includes a detonator which is set off by a striker rod which in turn is located forwardly of the safety device and is arranged to be driven rearwardly into the detonatory of the safety device, assuming the latter has been neutralized, under the action of the gases created by the burning of the forwardmost incendiary charge.

4 Claims, 1 Drawing Figure

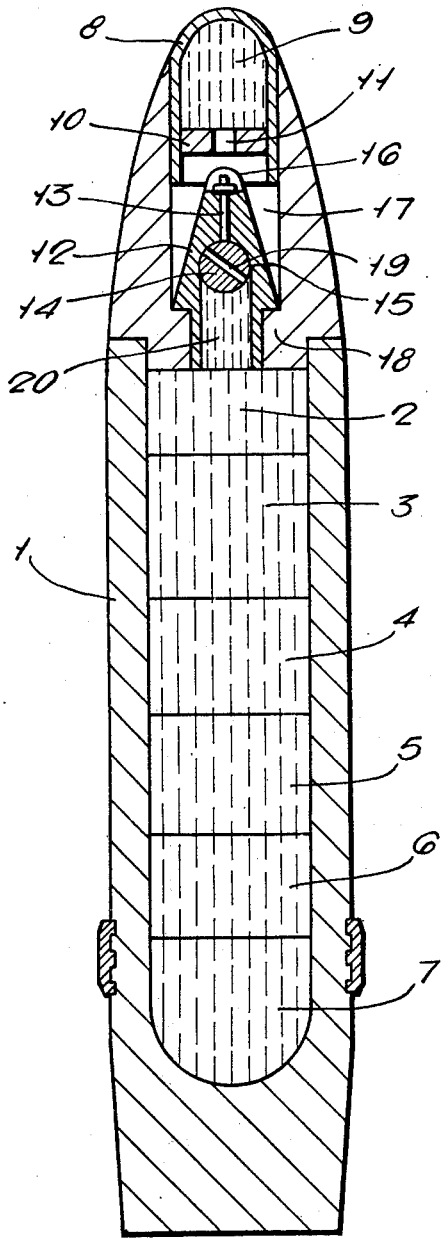
8
9
11
10
16
13
17
12
19
14
15
20
18
2
3
1
4
5
6
7

PROJECTILE HAVING AT LEAST TWO CHARGES

The present invention relates to a projectile or shell of the kind provided with at least two charges, of which the forwardmost is an incendiary charge arranged in the pointed end or the nose of the projectile, which charge is intended to be ignited by the impact of the projectile against a target. Further, rearwardly in the projectile there is at least one further charge which can be an incendiary charge or a high explosive charge. The invention also comprises projectiles containing one or more incendiary and/or high explosive charges in addition to the forwardmost incendiary charge.

Projectiles of the above type are known. The bursting of such projectiles occur by the ignition of the forwardmost incendiary charge which preferably is located in a hollow casing at the forwardmost end of a nose part, said hollow casing being made from relatively soft material as for example aluminium, such ignition being caused by the impact against a target without the necessity of any mechanical ignition device. The rearwardly located charges are then ignited in succession.

Such projectiles have the substantial advantage that the forwardmost incendiary charge ignites also by oblique impact against a target, due to the fact that said charge is not dependant on a centered shock to be ignited.

For projectiles of the kind here considered it is, especially for the larger calibers (40 mm and larger), desirable to have a safety to prevent blow-up of the rear charges if the forwardmost charge is ignited by an accident, for instance due to a bump or jamming of the projectile in the gun. The forwardmost incendiary charge can be so small that it in itself does not constitute any danger as compared with the rest of the projectile charges.

The main object of the present invention is to provide a projectile having an incendiary charge in the nose and at least one located charge rearwardly thereof, which projectile further is provided with a cheap but reliable safety device behind the forwardmost incendiary charge.

A projectile thus is proposed having the advantages of the arrangement of nose-incendiary-charge as to functional reliability also for oblique impact against a target, said projectile further being safeguarded before the firing by means of such conventional and simple means as a rotation safety and a striker rod. The striker rod will in this case work as a gas driven piston located at some distance from the pointed end of the projectile which is contrary to the usual arrangement of the striker rod forwardmost in the nose in connection with the use of fuse. The striker rod thus is protected against impacts and shocks. The projectile further can be provided with transport-, barrel- or masksafety in the form of a lock for the striker rod or the rotatable body. Another substantial advantage obtained is that there is nearly no possibility for the striker rod to be broken or jammed at the impact against the target, due to the fact that it has no mechanical contact with parts of the projectile situated in front of the striker rod.

The forwardmost incendiary charge usually is supported by a disc having a through-going hole. This arrangement has for its object to prevent setback of the charge at the firing moment and to prevent the charge or parts thereof to beat against the striker rod. The combustion gases and the flame passes from the charge through the hole in the disc and out in the space forward of the striker rod where a pressure is built up which drives the rod backwardly.

As the rise in pressure occurs very fast it is usually not necessary to have any sealing around the striker rod to prevent building up of a counterpressure at the pointed end thereof.

A membrane may, if desired, be arranged in front of the striker rod so that less pressure is necessary to drive it backwardly.

In accordance with an embodiment of the invention the rotatable safety and the striker rod can be mounted in a body which forms the projectile nose, but is located behind the projectile point proper which contains an incendiary charge. Thereby, a point body of existing type can be applied. Such a body may contain a detonator for example in the hole through the rotatable safety and further a transfer charge and thus can be a conventional fuse.

Referring to the drawing an embodiment there disclosed as an example of the invention shall be further described.

The main body of the projectile can be a hollow cylinder 1 usually made from steel and containing at least one main charge, usually several charges of the incendiary and/or high explosive types 2 - 7.

The incendiary charge includes a hollow casing at the forward end of the nose 8, which usually is made from a softer material as for instance aluminium, and it contains an incendiary material 9 supported by a disc 10 provided with a hole 11.

Behind the point proper of nose 8 a member 12 is arranged containing a striker rod 13 and a rotatable safety 14, a detonator 19 being provided in a bore 15. In the example shown the member 12 and its content constitutes a fuse. This is however, not necessary as the striker rod and safety device can be arranged in a separate member.

The forwardmost end of the member 12 is provided with a protection cap 16, which functions as a membrane reacting on the pressure arising in the space 17 by the burning of the forwardmost incendiary charge.

In the example shown the nose 8 and the member 12 are both located in a nose portion adapter 18. It falls within the scope of the invention to secure the member 12 and the nose 8 to a main body or to each other in an arbitrary way.

I claim:

1. A projectile having a forwardmost incendiary charge located at the forward end of the projectile, said incendiary charge including a hollow casing at the very front end of the projectile of sufficiently soft material to distort upon impact, and an incendiary material filling said hollow casing, said incendiary charge being arranged to be ignited upon distortion of the said incendiary charge upon impact of the projectile against a target, and at least one other charge located rearwardly thereof, a rotatable safety device located rearwardly of said forwardmost incendiary charge and forwardly of said other charge or charges, a striker rod arranged just rearwardly of the forwardmost incendiary charge and positioned to be driven into a detonator of the safety device when the safety device has been neutralized, the forward end of the striker rod being positioned, and comprising means, for driving the striker rod rearwardly into the detonator for detonating said other charge or charges, under the action of the gas pressure built-up rearwardly of the forwardmost incendiary charge upon ignition thereof.

2. A projectile according to claim 1, wherein the safety device and the striker rod are mounted in a fuse which also comprises an auxiliary charge.

3. A projectile according to claim 1, said projectile having a nose part at the forward end thereof and including a member containing at least the safety device and the striker rod and mounted in the said nose part of the projectile and wherein said forwardmost incendiary charge is mounted at the forward end of the nose part.

4. A projectile according to claim 1, wherein the rear of the forwardmost incendiary charge is supported by a disc having a through-going hole therein.

* * * * *